US011202475B2

(12) United States Patent
Milling

(10) Patent No.: US 11,202,475 B2
(45) Date of Patent: Dec. 21, 2021

(54) SAW PROTECTION

(71) Applicant: HUSQVARNA AB, Huskvarna (SE)

(72) Inventor: Johan Milling, Falun (SE)

(73) Assignee: Husqvarna AB, Huskvarna (SE)

( * ) Notice: Subject to any disclaimer, the term of this patent is extended or adjusted under 35 U.S.C. 154(b) by 298 days.

(21) Appl. No.: 15/762,646

(22) PCT Filed: Sep. 23, 2015

(86) PCT No.: PCT/EP2015/071900
§ 371 (c)(1),
(2) Date: Mar. 23, 2018

(87) PCT Pub. No.: WO2017/050373
PCT Pub. Date: Mar. 30, 2017

(65) Prior Publication Data

US 2018/0271186 A1 Sep. 27, 2018

(51) Int. Cl.
*A41D 13/05* (2006.01)
*A41D 13/06* (2006.01)
*A41D 31/24* (2019.01)

(52) U.S. Cl.
CPC ..... *A41D 13/0543* (2013.01); *A41D 13/0562* (2013.01); *A41D 13/0575* (2013.01); *A41D 13/065* (2013.01); *A41D 31/245* (2019.02)

(58) Field of Classification Search
CPC ..... A41D 13/0543; A41D 13/065; A41D 13/0575; A41D 13/0562; A41D 31/245; F41H 5/04; F41H 5/048; Y10T 442/2615; Y10T 442/2631; B32B 2437/00; B32B 2571/02; B32B 2571/00; A63B 71/1225
See application file for complete search history.

(56) References Cited

U.S. PATENT DOCUMENTS 4,079,464 A * 3/1978 Roggin ..... F41H 1/02 2/2.5
4,280,342 A 7/1981 Eng et al.
4,351,065 A * 9/1982 Bouchard ..... A41D 13/05 2/23
5,095,544 A 3/1992 Elverskog
(Continued)

FOREIGN PATENT DOCUMENTS

EP 2409585 A2 * 1/2012 ..... A41D 1/067
EP 2409585 A2 1/2012
(Continued)

OTHER PUBLICATIONS

International Preliminary Report on Patentability for International Application No. PCT/EP2015/071900 dated Mar. 27, 2018.
(Continued)

*Primary Examiner* — Jennifer A Steele
(74) *Attorney, Agent, or Firm* — Burr & Forman, LLP

(57) ABSTRACT

A protective clothing (100) comprising saw protective layering regions (110) comprising saw protection filler material, wherein said saw protective layering regions (110) has at least one reinforced section (120). A reinforced section (120) is also disclosed comprising saw protection filler material, said reinforced section (120) arranged to be removably arranged to protective clothing (100).

13 Claims, 3 Drawing Sheets

(56) References Cited

U.S. PATENT DOCUMENTS

| | | | | | |
|---|---|---|---|---|---|
| 5,375,262 | A * | 12/1994 | Carter | A41D 13/0543 | 2/22 |
| 5,480,376 | A * | 1/1996 | Duback | A41D 13/015 | 602/8 |
| 5,918,309 | A * | 7/1999 | Bachner, Jr. | F41H 5/0457 | 2/2.5 |
| 2001/0002491 | A1* | 6/2001 | Ehr | A41D 13/06 | 2/23 |
| 2012/0017345 | A1* | 1/2012 | Stensgaard | A41D 13/0543 | 2/24 |
| 2014/0230116 | A1* | 8/2014 | Weber | A41D 13/0568 | 2/22 |
| 2015/0059045 | A1* | 3/2015 | Supper | A41D 13/065 | 2/24 |

FOREIGN PATENT DOCUMENTS

| | | | | |
|---|---|---|---|---|
| EP | 2672850 | B1 * | 6/2016 | A41D 13/0543 |
| JP | S53-141111 | U | 11/1978 | |
| JP | S54-030530 | U | 2/1979 | |
| JP | S63-085611 | U | 6/1988 | |
| JP | H06-128421 | A | 5/1994 | |
| JP | 2010077579 | A * | 4/2010 | |
| JP | 2010077583 | A | 4/2010 | |
| KR | 20100040027 | A | 4/2010 | |
| SE | 8902533 | L | 1/1991 | |

OTHER PUBLICATIONS

International Search Report and Written Opinion for International Application No. PCT/EP2015/071900 dated Jul. 18, 2016.

* cited by examiner

FV

SAW PROTECTION

FIELD

This invention relates to protective trousers and chaps for use by operators of chainsaws in operations such as the felling and de-branching of trees, and the sawing of the felled trees and branches.

BACKGROUND

In this specification, a "trouser" or "pair of trousers" is construed as any garment comprising portions that separately enclose at least a substantial part of the legs of the wearer and are united at a crotch, i.e. a joint between the legs that faces downwardly in the standing position of the wearer; and the "fly" is defined by a nominal line extending upwardly and centrally in front of the wearer in a vertical plane from the crotch to the waist in the standing position of the wearer. Typically the fly is openable and closable by a zip or other fastening means. A "chaps" or "pair of chaps" is construed as a garment comprising portions that separately cover at least a substantial part of the legs of the wearer.

The principal risk arising from the operation of a chainsaw is that of contact between the moving chain and the operator, in particular the legs. To give some protection for the legs it is customary for the chainsaw operator to wear protective trousers comprising an outer layer, hereinafter referred to as the shell, which encloses a protective filler material comprising long fibres of high strength material such as para-aramid (e.g. Kevlar®), ballistic nylon, high performance filament yarn made of PET (Poly Ethylene terephtalat), PP (PolyPropylene) or PE (Poly Ethylene), PA (Poly Amide) (for example materials such as Dyneema® or Vectran® etc) which are loosely arranged, usually in multiple layers. When a chainsaw chain contacts the trousers, the outer layer is immediately cut through but the loose fibres of the filler material are drawn out and entangled by the blade so that they wrap around the chainsaw's drive sprocket, locking it solid and halting the chain, and so limiting damage to the operator's leg. After stopping a saw, the trousers are scrapped, and the saw must be field-stripped to remove the fibres and allow it to run again.

The filler material may be arranged in a fabric envelope which contains the loose layers of fibres and is sewn to the inside of the shell. This avoids the need to sew the filler material to the shell, which could restrain the fibres of the filler material and hence prevent them from stopping the blade.

Chainsaw protective trousers in the EU must comply with EN381-5 and are classified in three classes and three types, depending on the quantity and arrangement of the filler material. Class 1, 2 and 3 trousers are rated for use with chainsaws running at speeds up to 20 m/s, 24 m/s and 28 m/s respectively, with the requisite level of protection typically being provided by about 3 to about 12 or even more layers of filler material.

Apart from the standard having three protective classes (1,2,3) the standard also has three design classes A, B and C, where design class C protects the whole legs.

Tree fellers, ground workers and firewood cutters typically select design class A trousers because of the low risk of being cut in the back of the leg. Climbers and tree surgeons generally have the chainsaw attached by a lanyard to their climbing harness and select design class C, as they will be cutting from a wider variety of positions. In design class A and B trousers the filler material is arranged to cover principally the front of the legs, whereas type C trousers provide filler material that extends around the front and back so as to enclose each leg. In each type, the filler material extends upwardly from the crotch for some distance on each side of the fly, while the seat (the region behind the wearer between the waist and the legs) is not filled.

Some users, like occasional or non-professional users, prefer chaps, which comprise a shell and filler material similar to those of trousers but arranged as two separate leg coverings (or attached to one another), usually lacking a seat and united by a belt or the like and providing design class A protection, and which are worn over conventional trousers.

The fibres of the filler material are relatively inelastic. In chainsaw protective trousers it is desirable for the filler material to extend as far as possible over the leg regions including the thighs, chins, knees and also the backside including the buttocks of the user since these areas are vulnerable to contact by the chainsaw blade.

The shell of chainsaw protective trousers or chaps is preferably both tough and slippery so that it protects against trivial damage which could compromise the filler material. Kneepatches of an abrasion resistant material such as a para-aramid (e.g. Kevlar®) cloth are usually sewn to the shell to protect the clothing against wear and tear.

In order to ensure that the shell is comfortable in use and does not unduly restrict the movement of the wearer, particularly when climbing trees, it is preferable to make it from a material, e.g. a warp knitted synthetic fabric, that is elastically stretchable as well as water repellent.

SUMMARY

The inventors have realised that there is a problem in contemporary protective clothing, such as for protective chainsaw pants or chaps, but also for protective jackets, in that as the user working in nature is often forced to assume working positions requiring the user to bend, stoop, squat or otherwise bend one or more joints (particularly such as when squatting or bending a knee). The areas of the protective clothing around the bending joint will then become stretched around the corresponding limb(s) whereby the protective clothing may become taut. This may have the consequence that the filler material fibres may also become stretched and their freedom to move and be caught by a chainsaw chain may thus be compromised or reduced leading to a reduced protection in those areas in such awkward working positions.

Especially in rough terrain or such as when climbing trees where a user is forced to assume many awkward working positions, this may pose a problem, and it is this problem that the inventors have realized after insightful reasoning.

The inventors further recognises that, whereas the shell should be sufficiently elastic so as to provide comfort in use, they should also not be too loose fitting as that would decrease the comfort in that the pants would bulge.

It is the object of the present invention, some aspects of which is a problem invention, to provide protective clothing such as chainsaw protective trousers or chaps (possibly which can be secured, such as by being sown together, in the crotch area) which afford protection and comfort, even in awkward working positions.

In accordance with the present invention there is provided protective clothing such as a pair of trousers or chaps as defined in the claims.

In one embodiment there is provided a protective clothing comprising saw protective layering regions comprising saw protection filler material, wherein said saw protective layering regions has at least one reinforced section.

In accordance with the present invention there is provided joint pads to be arranged on protective clothing such as knee pads as defined in the claims. The joint pads may be removably arranged to the protective clothing. The joint pads may alternatively or additionally be sown to the protective clothing.

In one embodiment there is provided a reinforced section comprising saw protection filler material, said reinforced section arranged to be removably arranged to protective clothing.

Other features and advantages of the disclosed embodiments will appear from the following detailed disclosure, from the attached dependent claims as well as from the drawings

BRIEF DESCRIPTION OF DRAWING

The invention will be described below with reference to the accompanying figures wherein.

DETAILED DESCRIPTION

Figure 1:
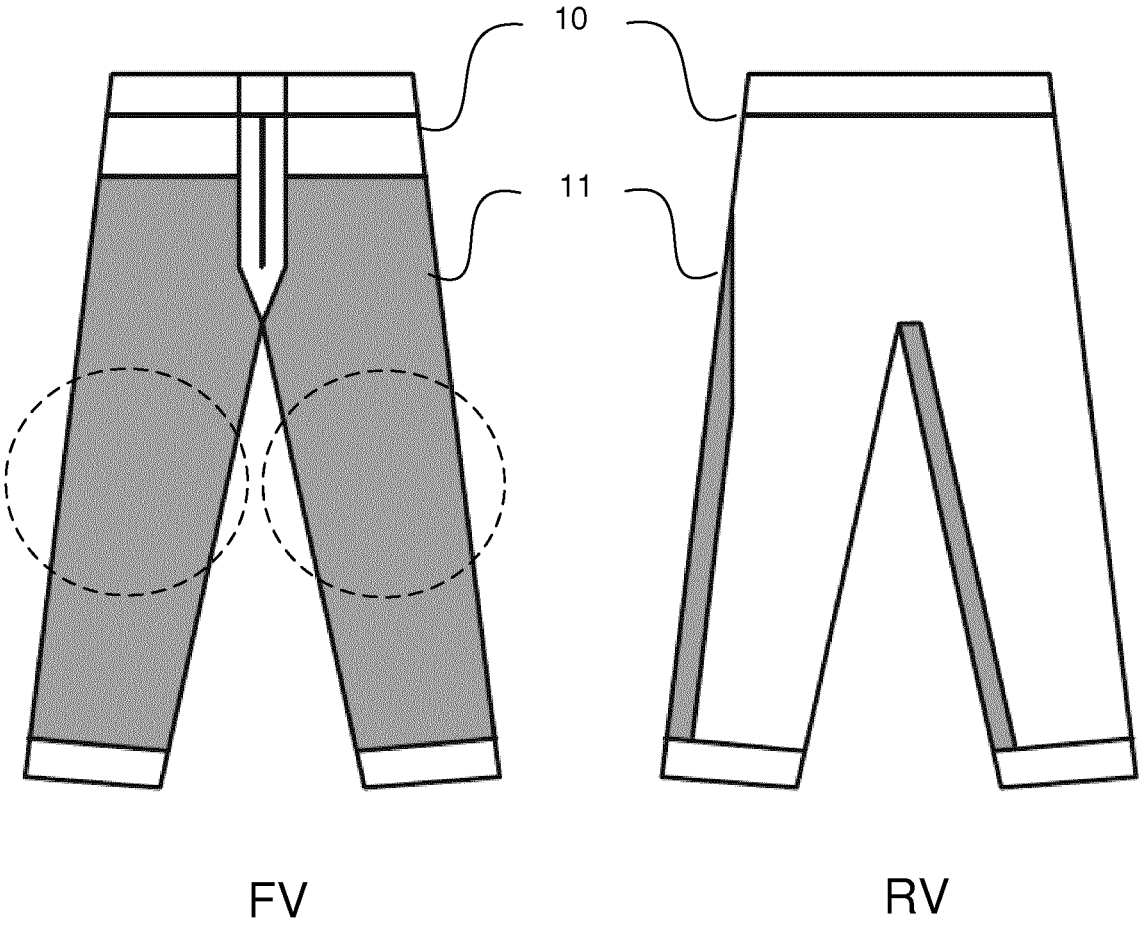
FIG. 1 is a schematic illustration of prior art protective clothing.

FIG. 1 is a schematic illustration of prior art protective clothing, in this example protective trousers 10. The trousers are shown both in a front view (FV) and a rear view (RV) and they are of a design type A as can be seen as the fronts of the legs are reinforced by a protective layering regions 11 extending over the front of the legs of the trousers 10. The extent of the protective layering is only an example and as would be apparent to a skilled person the protective layering could have other shapes, forms and extents, possibly extending all round the legs and also the buttocks of the trousers as per higher design types. For other types of protective clothing, such as jackets, chaps, vests, arm protectors, show protectors etc other forms, shapes and extents of the protective layering is possible. A "chaps" or "pair of chaps" is construed as a garment comprising portions that separately cover at least a substantial part of the legs of the wearer. The chaps may have an open crotch area thus comprising two separate leg covers, or comprising leg covers that are attached to one another at the crotch are thereby providing protection also in the crotch area.

The protective layering regions 11 comprises sections of filler material that may be attached to a shell as has been disclosed in the above for enclosing the filler material and protecting it from wetness and humidity. The prior art protective layering regions 11 is of a substantially uniform thickness.

As has been discussed in the above, the inventors have realized that when the user bends a joint for example a knee, such as when operating in awkward positions or climbing, areas of the protective layering regions 11 may become taut in areas protecting and the protective capability may then be reduced. In FIG. 1 such areas are indicated by dashed circles. These circles only indicate example areas and actual areas may differ in size and position. For example, for tight trousers, the areas may extend higher up on the thighs, and/or lower down over the chins—at least partially. Various shapes and placements of such areas are therefore possible especially for different types of clothing.

Figure 2:
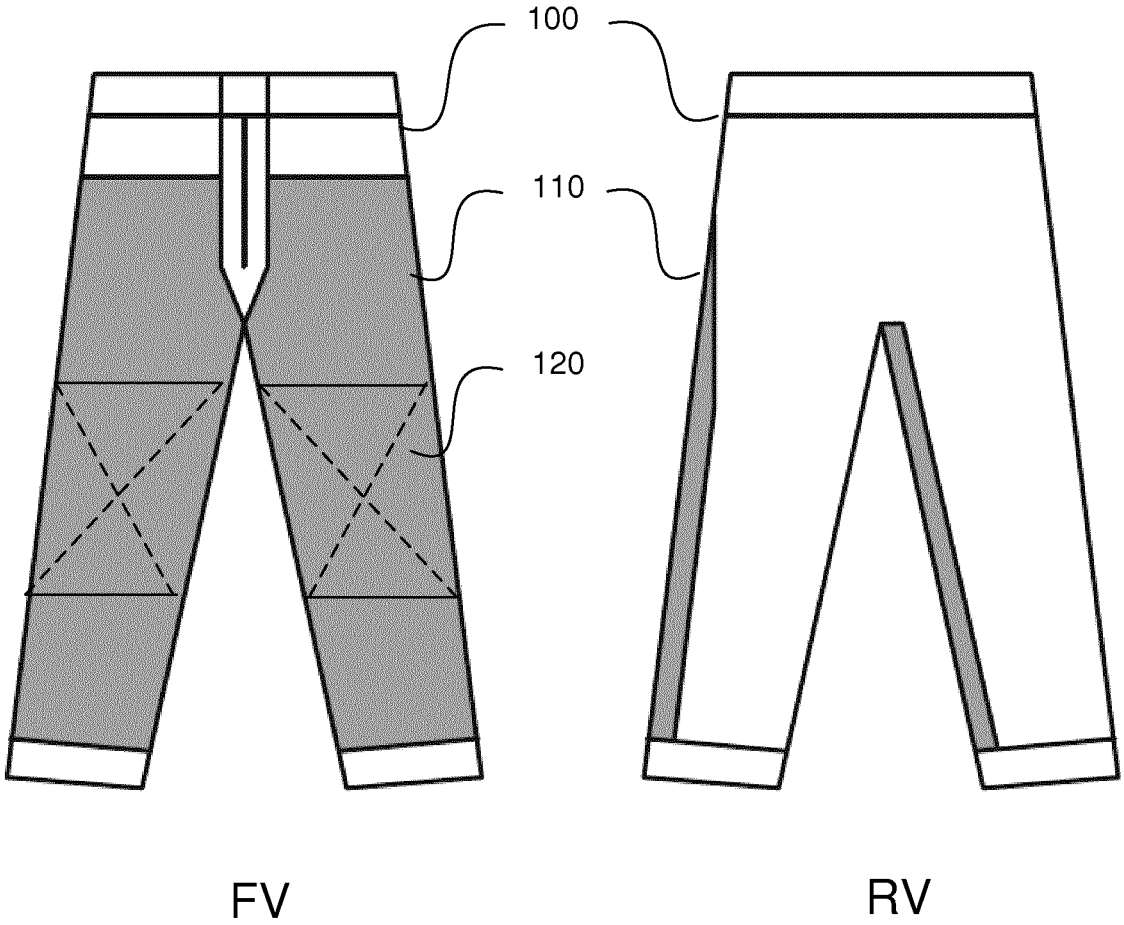
FIG. 2 is a schematic illustration of protective clothing according to one embodiment of the invention.

FIG. 2 is a schematic illustration of protective clothing according to an embodiment, in this example protective trousers 100. The trousers are shown both in a front view (FV) and a rear view (RV) and they are of a design type A and the fronts of the legs are reinforced by a protective layering regions 110 extending over the front of the legs of the trousers 100.

The inventors have realized that the protective capability of the filler material in the protective layering regions 110 may be maintained (or even increased) even when a protected joint, such as a knee, is bent by simply and elegantly adding to the filler material layering of in such areas.

To maintain the flexibility and weight of the protective clothing at substantially the same level, the inventors have realised that the saw protective layering only needs to be improved in the areas that become taut when bent.

In FIG. 2 two reinforced sections 120 are shown, one covering each respective knee area of the trousers 100.

The reinforced sections 120 may be reinforced for added protective capabilities by adding more saw protection layers to the protective layering, for example by adding 2 more layers. In one embodiment 1 to 5 more layers are added. one embodiment 2 to 4 more layers are added. one embodiment 2 or 3 more layers are added.

The added layers may have a same thickness as per the non-reinforced sections, which provides for simpler material handling and acquisition during production.

The added layers may alternatively or additionally have a different thickness as per the non-reinforced sections, which provides for fewer layers needed to be added during production. The reinforced sections 120 may thus also or alternatively be reinforced for added protective capabilities by adding to the thickness of the protective layering in such areas.

The added layers may alternatively or additionally have a longer length of the fibres in the filler material as per in the non-reinforced sections.

The added layers may alternatively or additionally have a different orientation of the fibres in the filler material as per in the non-reinforced sections.

The reinforced sections thus comprise more filler material than other areas of the saw protective layering regions, whether by a higher thickness, by additional layers or by longer fibres (or other manner of increasing the amount of filler material that may be used). The reinforced sections are thus mainly reinforced by having more filler material than other areas of the protective layering regions.

Figure 3:
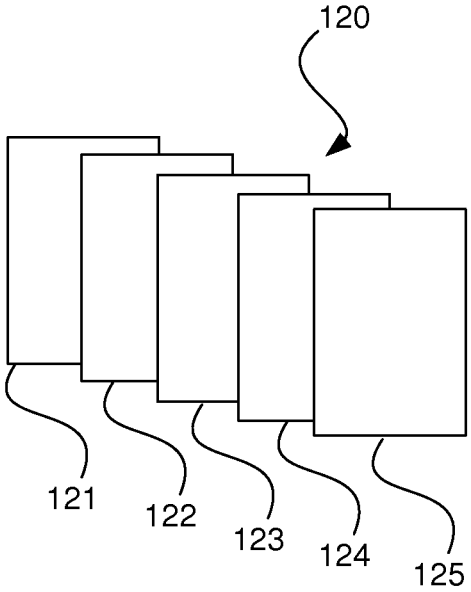
FIG. 3 shows a schematic exploded view of a reinforced section according to one embodiment of the invention.

FIG. 3 shows a schematic exploded view of a reinforced section 120. In this example embodiment the reinforced section 120 has an additional two protective layers 122, 123.

The inventors further realized that adding more (and/or thicker) layers will also serve to provide added protection to the joint such as when standing on a knee, the added layering serving as a cushioning knee (or other joint) pad. To improve the cushioning effect, a spacer layer 124 may also be added to the reinforced section 120. The spacer layer 124 may be made of polyester or other suitable materials. As the spacer is relatively rigid in its structure, at least compared to the filler material, it carries an additional benefit in that as it is prone to keep its form even when it is bent, it will help to preserve the form of the reinforced section 120 thereby possibly preventing the saw protection or filler material from becoming as taut.

In one embodiment, at least one of the reinforced sections are provided in the form of a joint pad to be added to the protective clothing.

The joint pad may be added to the protective clothing by being removably inserted into a pocket of the protective clothing.

The joint pad may be alternatively be added to the protective clothing by being sown onto or into (for example under the shell layer) of the protective clothing.

Figure 4:
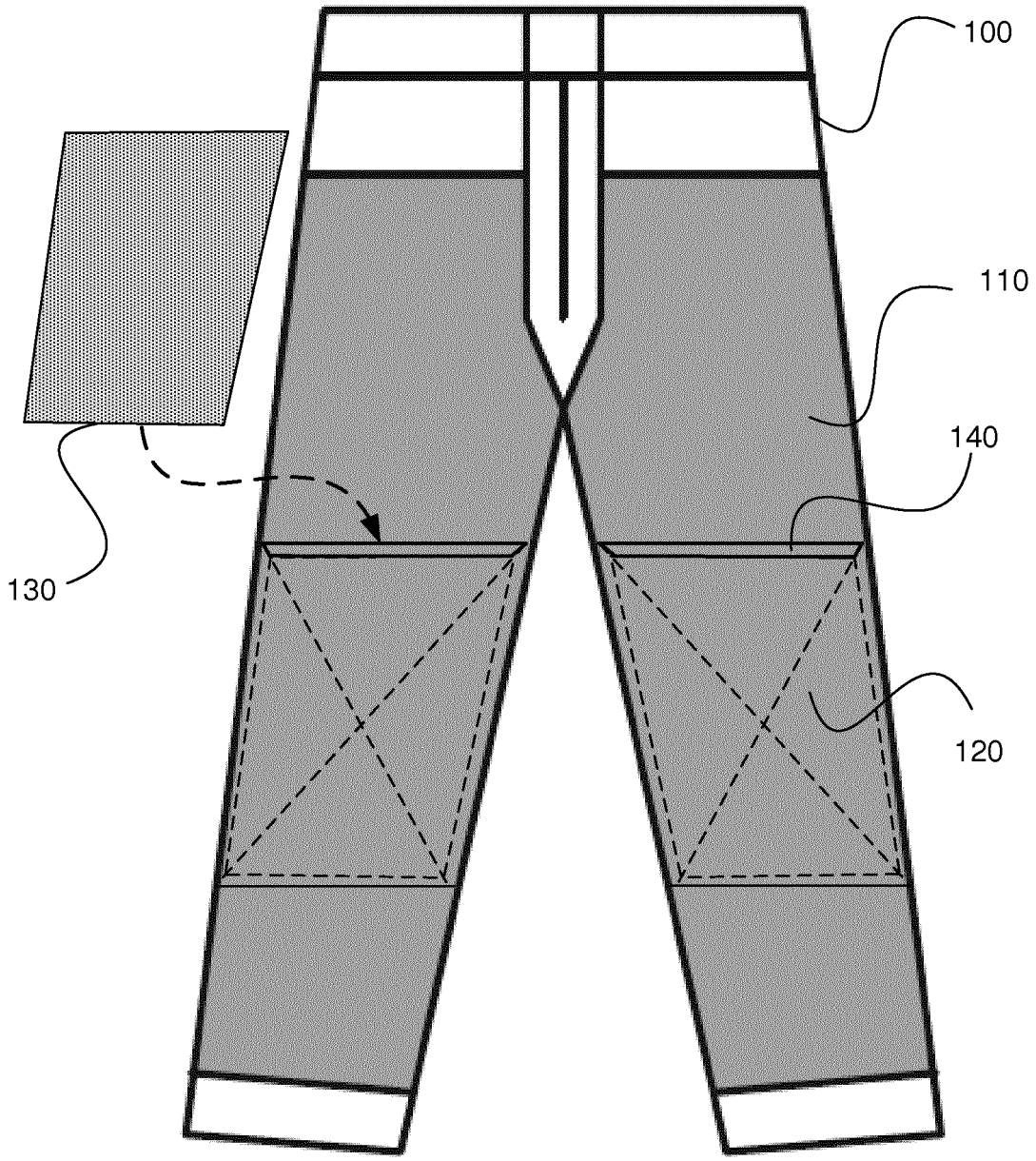
FIG. 4 shows a schematic illustration of a front view of a protective clothing according to one embodiment of the invention.

FIG. 4 shows a schematic illustration of a front view of a protective clothing 100, in this example trousers, where a pocket 140 is arranged to cover the areas that become taut when bent, in this example the knee areas. A joint pad 130 is also shown in FIG. 4 and the joint or, in this example, knee pad 130 is to be inserted into the one of the pockets 140 as is illustrated by the dashed arrow.

By arranging the reinforced sections 120 as a joint pad that can be inserted and/or removed, the reinforcement becomes both optional and replaceable. The joint pad can thus be replaced if it is damaged without having to replace the whole trousers.

In one embodiment the joint pad 130 is arranged in a pocket by itself and simply attached to the reinforced area for example using fastening means like buttons, hook-and-loop-fastening means (such as Velcro™), zippers or other manners of removably fastening a pad to clothing.

Arranging the reinforced sections 120 as a replacable pad thus has many benefits.

As has been mentioned above, the joint pad may also be sown to the protective clothing, possibly under an outer shell, becoming part of the protective clothing. This ensures that the joint pad stays in its intended position during use and also ensures that the pads are kept in place if contact should be made with a chainsaw chain.

Alternatively, both a removably joint pad and an attached joint pad may be arranged on the protective clothing.

Furthermore, the inventors have also realized that by selecting the shell layer 125 of the reinforced section as being a water repellent (or water proof) material, and preferably a stretch material, such as NAME OF MATERIAL, the joint may also be protected against wetness or humidity.

The reinforced section 120 may thus be arranged in one embodiment as one or more saw protective layers 122, 123, a spacer layer 124 and a water repellent shell material 125 that are sown (or otherwise attached) to a lining layer 121.

The reinforced section 120 may also be arranged in one embodiment as one or more saw protective layers 122, 123 and a water repellent shell material 125 that are sown (or otherwise attached) to a lining layer 121.

The reinforced section 120 may thus be arranged in one embodiment as one or more saw protective layers 122, 123, and a spacer layer 124 that are sown (or otherwise attached) to a lining layer 121.

As has been noted above, the protective clothing 100 is merely exemplified as being saw protective trousers, but may also be protective vests, chaps, jackets, arm chaps, shoe covers or other protective clothing.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A protective clothing comprising:

a saw protective layering region comprising a plurality of saw protection filler material layers, the saw protection filler material layer comprising loosely arranged fibers that are permitted to be drawn out when coming in contact with a moving chain blade of a chainsaw; and a reinforced section disposed on an external side of the saw protective layering region relative to a body of a user when wearing the protective clothing, the reinforced section being positioned to be aligned with a joint of the user when wearing the protective clothing, the reinforced section having an internal side adjacent to the saw protective layering region;

wherein the reinforced section comprises:

a lining layer disposed on the internal side of the reinforced section, a plurality of additional saw protection filler material layers disposed external to lining layer, the additional saw protection filler material layers also comprising loosely arranged fibers that are permitted to be drawn out when coming in contact with a moving chain blade of a chainsaw, the additional saw protection filler material layers adding to a rigidity of the reinforced section relative to the saw protective layering region, and a water repellant shell material layer disposed external to the plurality of additional saw protection filler material layers to protect the plurality of additional saw protection filler material layers of the reinforced section from wetness and humidity;

wherein the lining layer, the plurality of additional saw protection filler material layers, and the water repellant layer are sewn together to form at least a portion of the reinforced section.

2. The protective clothing to claim 1, wherein said saw protective layering region has a substantially uniform thickness and wherein the plurality of additional saw protection filler material layers of the reinforced section are thicker than the saw protection filler material layer of the saw protective layering region.

3. The protective clothing according to claim 1, wherein said reinforced section is removably arranged on the saw protective layering region.

4. The protective clothing according to claim 3, wherein said reinforced section is arranged to be insertable into a pocket on the saw protective layering region.

5. The protective clothing according to claim 1, wherein said reinforced section is removably fastened to the saw protective layering region through the use of buttons or a hook-and-loop fastening means.

6. The protective clothing according to claim 1, wherein the protective clothing is saw protection trousers and the reinforced section is arranged over a knee area of said saw protection trousers.

7. The protective clothing according to claim 1, wherein the protective clothing is saw protection chaps and the reinforced section is arranged over a knee area of said saw protection chaps.

8. The protective clothing according to claim 1, wherein the protective clothing is a protective jacket or arm chaps.

9. A protective clothing comprising:

a saw protective layering region comprising a saw protection filler material layer, the saw protection filler material layer comprising loosely arranged fibers that are permitted to be drawn out when coming in contact with a moving chain blade of a chainsaw; and a reinforced section affixable to an external side of the saw protective layering region relative to a body of a user when wearing the protective clothing, the reinforced section being positioned to be aligned with a joint of the user when wearing the protective clothing, the reinforced section having an internal side adjacent to the saw protective layering region;

wherein the reinforced section comprises:

a lining layer disposed on the internal side of the reinforced section;

a plurality of additional saw protection filler material layers disposed external to the lining layer, the additional saw protection filler material layers also comprising loosely arranged fibers that are permitted to be drawn out when coming in contact with a moving chain blade of a chainsaw, the additional saw protection filler material layers adding to a rigidity of the reinforced section relative to the saw protective layering region; and a water repellent shell material layer disposed external to the plurality of saw protection filler material layers to protect the plurality of additional saw protection filler material layers of the reinforced section from wetness and humidity;

wherein the lining layer, the plurality of additional saw protection filler material layers, and the water repellant layer are sewn together to form at least a portion of the reinforced section; and wherein said reinforced section is removable from the saw protective layering region.

10. The protective clothing according to claim 9 further comprising a spacer layer; and wherein the water repellent shell material layer is disposed external to a spacer layer.

11. The reinforced section according to claim 9 comprising a spacer layer, the spacer layer having a rigid structure.

12. A protective clothing comprising:

a saw protective layering region comprising a first layer of saw protection filler material, the first layer of saw protection filler material comprising a layer of loose fibres that are permitted to be drawn out when coming in contact with a moving chain blade of a chainsaw; and a reinforced section disposed an external side of the saw protective layering region relative to a body of a user when wearing the protective clothing, the reinforced section being positioned to be aligned with a joint of the user when wearing the protective clothing, the reinforced section comprising:

one or more additional layers of saw protection filler material, the one or more additional saw protection filler material layers also comprising loosely arranged fibers that are permitted to be drawn out when coming in contact with a moving chain blade of a chainsaw, the one or more additional saw protection filler material layers adding to a rigidity of the reinforced section relative to the saw protective layering region; and a water repellant shell material layer disposed external to the plurality of additional saw protection filler material layers relative to a body of a user when wearing the protective clothing, the water repellant shell material being configured to protect the one or more additional saw protection filler material layers of the reinforced section from wetness and humidity;

wherein the one or more additional saw protection filler material layers and the water repellant layer are sewn together to form at least a portion of the reinforced section; and wherein the saw protection filler material of the first layer of the saw protective layering region is formed of a same material as the saw protection filler material of the one or more additional layers of saw protection filler material.

13. The protective clothing of claim 12, wherein the loose fibres are para-aramid fibres.

* * * * *